US005758456A

United States Patent [19]

Case

[11] Patent Number: 5,758,456

[45] Date of Patent: Jun. 2, 1998

[54] DECK PLANK

[75] Inventor: Gordon M. Case, Sparks, Nev.

[73] Assignee: Royal Plastics Group, Woodbridge, Canada

[21] Appl. No.: 760,409

[22] Filed: Dec. 4, 1996

[51] Int. Cl.[6] ..... E04F 11/16

[52] U.S. Cl. ..... 52/177; 52/732.1; 52/732.2

[58] Field of Search ..... 52/177, 465, 466, 52/468, 469, 471, 731.1, 731.2, 731.3, 732.2, 737.6, 220.5, 793.1, 578, 581, 588.1

[56] References Cited

U.S. PATENT DOCUMENTS

| | | | |
|---|---|---|---|
| 5,031,083 | 7/1991 | Claesson | 52/732.2 X |
| 5,411,782 | 5/1995 | Jarvis et al. | 52/578 X |
| 5,461,199 | 10/1995 | Buard | 52/220.5 X |
| 5,522,196 | 6/1996 | Conroy et al. | 52/731.2 X |
| 5,613,339 | 3/1997 | Pollock | 52/177 X |

*Primary Examiner*—Creighton Smith

[57] ABSTRACT

A deck plank in the form of an elongated plastic channel having a mounting base, upright side walls terminating in cap engaging locking means and intermediate support means between the side walls, at least the upright side walls having a honeycomb structure, and a longitudinal generally planar plastic cap for closing the channel having edge formations adapted to engage and interlock with the side wall locking means. In its preferred form the entire channel is of a honeycomb structure, the channel wall cap engaging locking means are arcuate sockets and the cap edge formations are depending arcuate legs adapted to snap into the wall sockets.

12 Claims, 6 Drawing Sheets

DECK PLANK

FIELD OF THE INVENTION

This invention relates to planks formed of plastic for decks and the like and decking formed therewith.

BACKGROUND OF THE INVENTION

Conventional decks are usually of wood and consist of planks nailed to spaced underlying wood joists.

A typical deck comprises the use of nominal 2 inch by 6 inch planks having a dressed dimension of 1½ inches by 5½ inches secured to underlying joists spaced, for instance, on 16 inch centers.

Other decks involve nominal 2 inch by 4 inch and 2 inch by 8 inch wood planks secured to the supporting joists.

Such wood planks are subject to warping, rotting, splintering, splitting and require continual maintenance such as by staining and the like.

In addition, such wood planks are subject to being cored by carpenter ants, wasps and other insects.

While metal planks have been proposed such as the aluminum planks of U.S. Pat. No. 4,078,515 such planks are expensive and not really practical for wide spread use. Such planks become extremely hot under intense sunlight and they are also subject to corrosion particularly if exposed to salt water.

While plastic plank members have been proposed such as shown in U.S. Pat. No. 5,009,045 which solve a number of the problems with wood and metal planks, they are still relatively expensive to produce and are usually not adapted to be laid down as deck members on conventional support joists but require special mounting arrangements. Moreover, their strength to weight ratio is relatively low and they have a tendency to soften under high temperatures reached under a hot sun while concentrating heat on to the underlying support structure.

SUMMARY OF THE INVENTION

According to the present invention, there is provided a very economical plank of polymeric material which has a high strength to weight ratio and which exhibits high heat dissipation and low heat transfer and can be utilized in the same manner as the standard wood planks in the erection of the deck or in the replacement of a splintered or otherwise damaged wood plank in an existing deck.

More particularly, according to the invention, the deck plank comprises an extruded plastic base in the form of an elongated channel having a width according to the desired plank width and having upright side walls terminating in cap engaging means at their upper end, and at least one upright support intermediate said side walls, at least said side walls having a honeycomb structure, and a generally planar cap having a width to span said base and having edge formations adapted to interengage with said side wall cap engaging means to secure same to said base with said upright support supporting said cap against inward deflection intermediate said side walls.

In its preferred form both the bottom mounting wall of the channel and the intermediate support are of a honeycomb structure for maximum strength to weight ratio.

Further, in its preferred form, the honeycomb channel side walls are formed to provide a locking socket at their upper ends and said cap is provided with depending locking legs at the edges thereof to lockingly engage in said channel wall sockets.

More particularly, the socket of each of the side walls of the channel is in the form of an arc arching inwardly and downwardly of the side wall from the top thereof, and said depending cap locking legs each have an outwardly facing sickle like form comprising a short depending leg portion to engage the top of the channel side wall and an inwardly and downwardly arched leg extension shaped to correspond to the curvature of the channel wall socket and adapted to snap down thereinto to positively secure said cap against shifting, accidental removal and squeaking when walked thereon.

As the majority of the wood decks encountered employ 2 inch by 6 inch planks, having a dressed dimension of 1 and ½ inches and 5 and ½ inches, the invention will be particularly described with respect to plastic planks dimensioned to replace such wood planks or to form complete decks based on the use of such plank dimensions. On this basis, according to the invention, the channels will have a width of 5 and ½ inches and a depth of 1 and ½ inches and will be provided with a pair of spaced intermediate supports to provide additional intermediate support for the cap which spans between the channel side walls. It will be understood, however, that the invention is applicable to planks of other desired dimensions.

Further, according to this aspect of the invention, the bottom wall of the channel is provided at its center with a raised key way to receive and guide a hollow beam having a key way receiving central groove in its bottom wall and proportioned to rest on the upper surface of the channel base and to span between the upper ends of the intermediate supports to provide a substantially continuous cap supporting platform therebetween.

These and other features of the invention will be appreciated from the following description taken in conjunction with the accompanying drawings.

Figure 1:
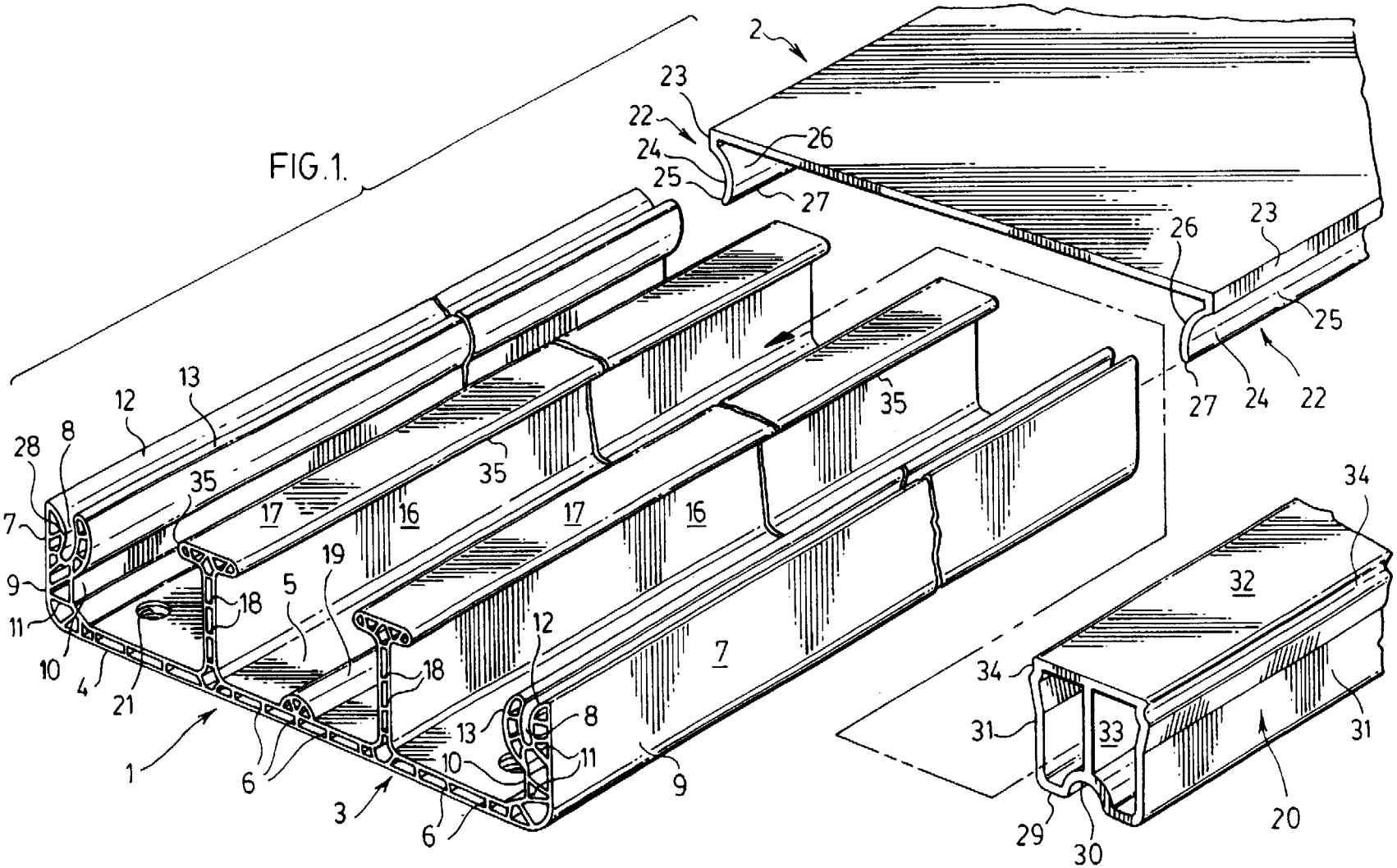
FIG. 1 is an exploded perspective view illustrating the channel base member of the plank about to receive the cap member and the optionally used center reinforcing beam insert. The plank illustrated being one corresponding to a conventional 2 by 6 inch wood plank.

DETAILED DESCRIPTION ACCORDING TO THE PREFERRED EMBODIMENTS OF THE PRESENT INVENTION

The plank illustrated and described herein is one to simulate the widely used conventional wood planks having nominal dimensions of 2 inches by 6 inches. It will be understood, of course, that the invention is equally applicable to planks of different dimensions which may be narrower or wider or greater or lesser depth and having lengths to suit the individual installation requirements.

The plank of the invention comprises two basic components, a longitudinal channel shaped base of plastic material generally designated at 1 and a longitudinal plastic cap generally designated at 2 which is adapted to cover the base and to be secured thereto with a positive snap lock connection as hereinafter more particularly described. Both the channel base and cap are preferably formed as extrusions of a suitable weatherable polyvinyl vinyl chloride (PVC).

The channel 1 has a bottom mounting wall 3 having a planar undersurface 4 and a spaced upper surface 5 and provided with webbing 6 spanning between the surfaces 4 and 5 to create a honeycomb structure.

The walls of the channel 1 generally designated at 7 project upwardly from the bottom wall 3 and terminate in arcuate sockets 8 at their upper ends.

The channel walls 7 have spaced outer and inner walls 9 and 10 respectively joined by webbing 11 to provide a honeycomb structure which carries into the walls 12 and 13 of the sockets 8.

Each of the sockets 8 has a convex outer wall segment 14 curving downwardly from the top of the wall and an inner opposing concave wall segment 15.

Intermediate the channel walls 7 are a pair of spaced upwardly projecting T-shaped support columns 16, the heads 17 of which project above the channel wall 7 and form flat intermediate support surfaces to prevent inward deflection of the cap 2 when weight is applied thereto.

Again the columns 16 including their heads 17 have a honeycomb structure with internal webbing 18.

The spacing between the support columns 16 is shown as slightly greater than the spacing between these columns and their adjacent channel side walls.

Centrally of the channel bottom and between the support columns 16 is a rounded rib or bead 19 running lengthwise of the channel to form a guide and locator for an optional reinforcing support beam 20 hereinafter more fully described.

The channel 1 is provided with mounting openings 21 in the outer sections between the channel walls and the support columns.

The cap 2 has a width to span the channel 1 and is provided with depending edge locking legs generally designated at 22 which have a sickle shape comprising a short straight depending leg portion 23 and an arcuate longer leg portion 24 having its concave surface 25 facing outwardly and its convex surface 26 facing inwardly.

The curvature of the arcuate leg sections 24 of the cap legs 22 correspond to the curvature of the arcuate sockets 8 of the channel walls 7.

When the cap 2 is placed over the channel 1 with the locking legs registering with the channel sockets 8, the application of sufficient downward force will cause the wall sockets to open slightly and the cap leg portions 24 to straighten slightly until the lower edges 27 of the leg portions 24 have passed the apex 28 of the outer socket walls 12 whereupon the resilient recovery of the deformed sockets and leg portions 24 cause the cap to snap down into a fully seated position in the sockets 8. This action is in the nature of an over center snap action.

Once the leg portions 24 have snapped down to their fully seated position the cap is positively held against movement so that it will be free from squeaking under walking on the plank and can be removed only by the exerting of substantial forces.

While the plank comprising the channel 1 and the cap 2 as described corresponds to a 2 by 6 wood plank, it will be appreciated that the invention is equally applicable to provide planks corresponding to a 2 by 4 inch wood plank in which case a single intermediate support column would be adequate. On the other hand, if the plank was to simulate a wider wood plank, additional support columns could be employed as required.

The support beam 20 shown in FIG. 1 comprises a hollow longitudinal extrusion of suitable thermoplastic material such as PVC having a bottom wall 29 provided with a central groove 30 to receive the central locating channel bead 19, side walls 31, a flat top platform 32 and a central web 33 running between the groove 30 and the top platform 32.

The height of the support beam 20 is such that when seated within the channel 1 its top platform 32 is flush with the flat heads of the T-shaped support columns 16.

Figure 3:
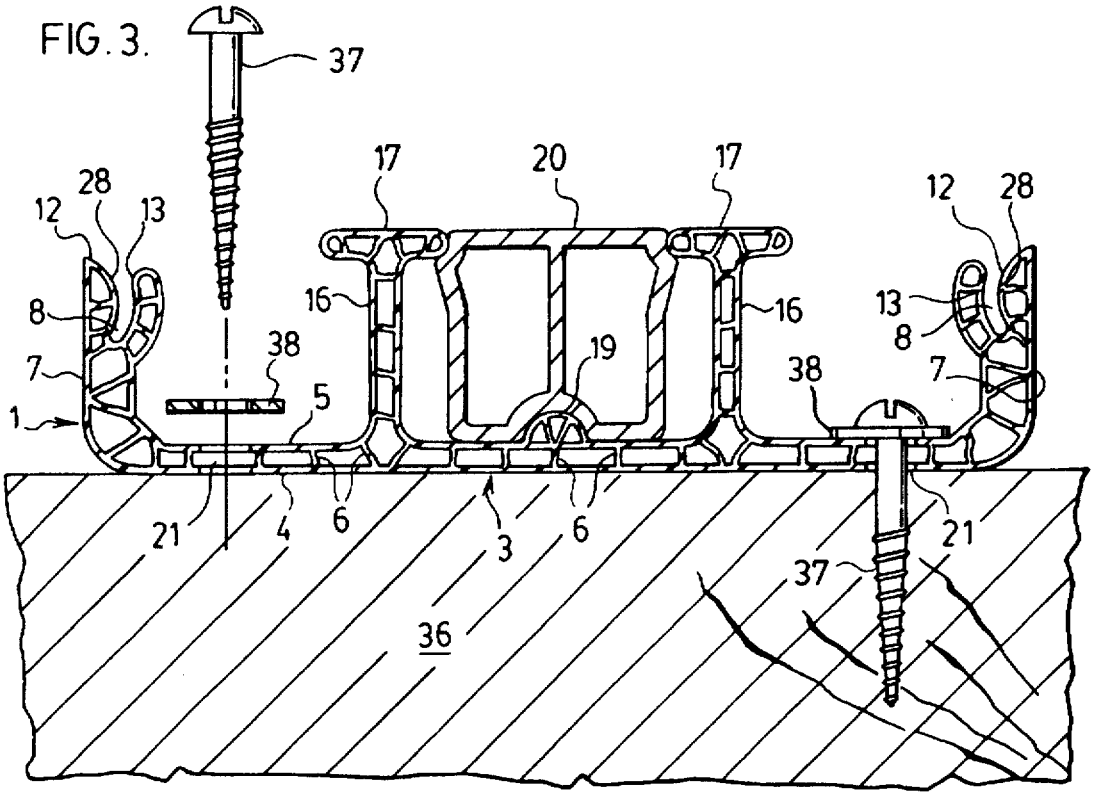
FIG. 3 is a vertical cross-sectional view illustrating the attachment of the plank channel base member to a wood joist with the optional central support beam being in position.
Figure 4:
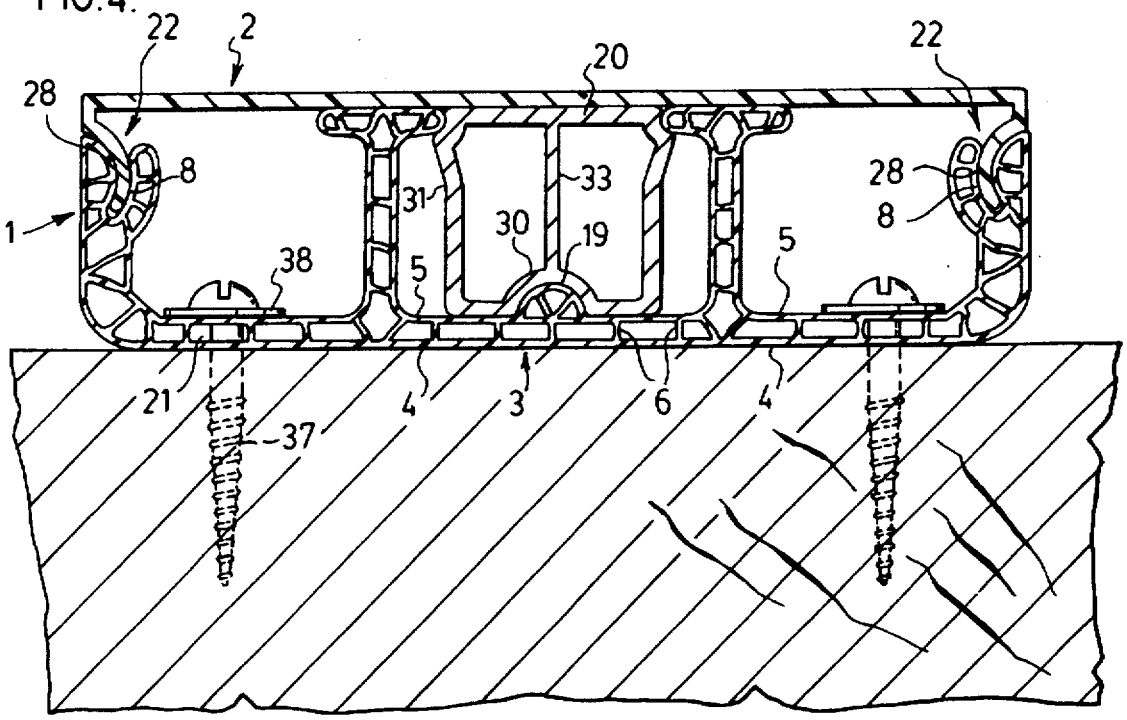
FIG. 4 is a view similar to FIG. 3 after the channel base has been fully secured and the cap snapped into locked position.

The side walls 31 of the support beam are grooved as at 34 to receive the rounded edges 35 of the column heads 17 as shown is FIGS. 3 and 4.

Figure 2:
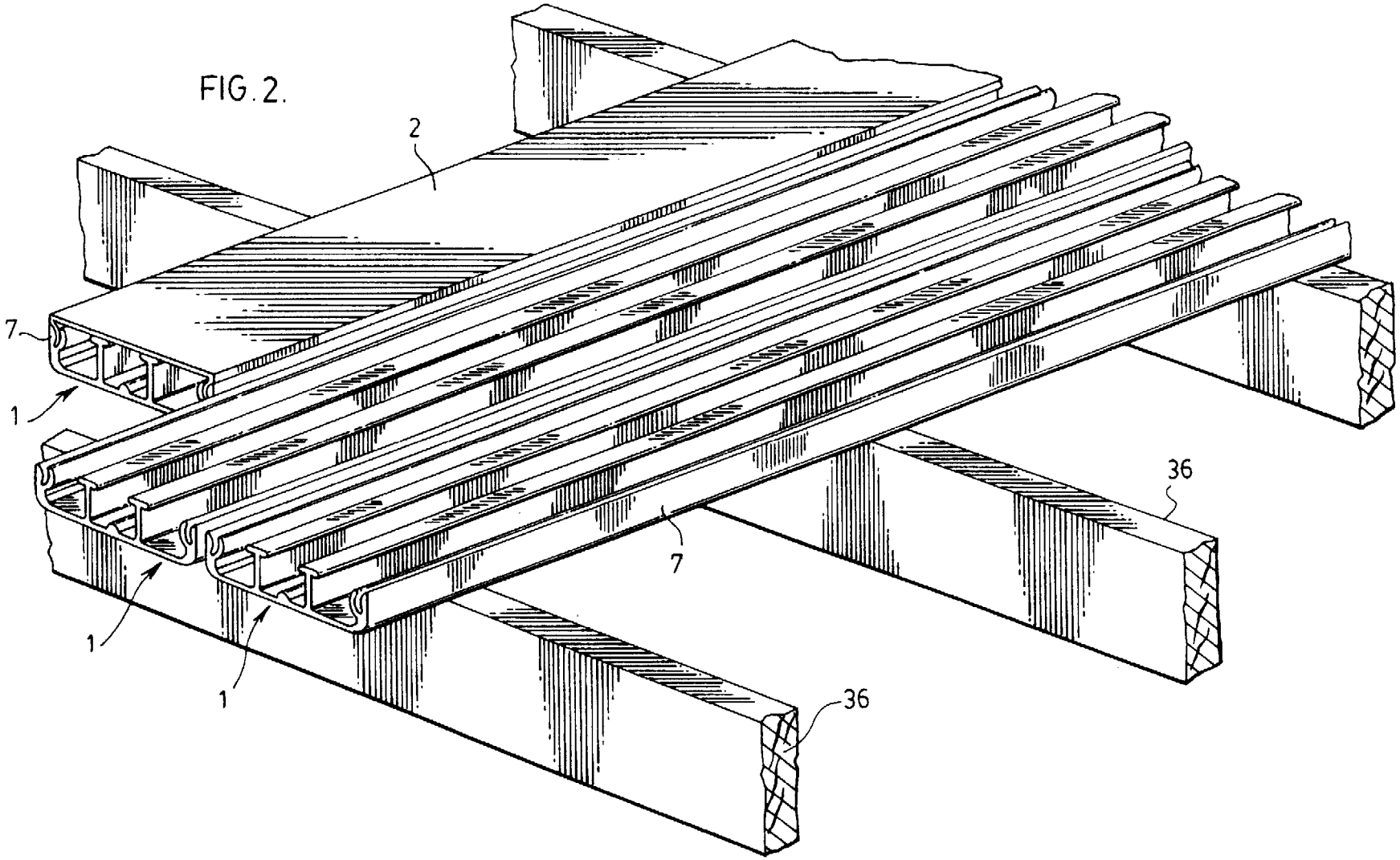
FIG. 2 is a broken away perspective view illustrating the assembly of planks according to the invention on supporting joists, one of the planks being shown with its cap in place while the two adjacent plank channel base members are without their caps.

FIG. 2 illustrates the forming of a deck by laying the planks of the invention on spaced support joists 36. It will be understood that the plank channel bases 1 will be secured in place and then the caps snapped into position. It will also be understood that if there is no restriction the caps can be slid into place from one end of the channel as well as being snapped down into the channel socke 8.

FIG. 3 illustrates the securement of a channel base of one of the planks. In this connection, it will be noted that the screw fastener 37 has a diameter less than the diameter of the mounting opening 21 and a resilient washer 38 is placed under the head of the screw 37.

In installing the channel, the screws 37 are torqued down sufficiently to firmly hold the channel in place but allowing channel creep under temperature changes by virtue of the oversize mounting openings 21.

FIG. 4 illustrates the completion of the mounting of a plank in which the optional support beam 20 has been inserted between the support columns 16 and the cap 2 snapped into place.

Figure 5:
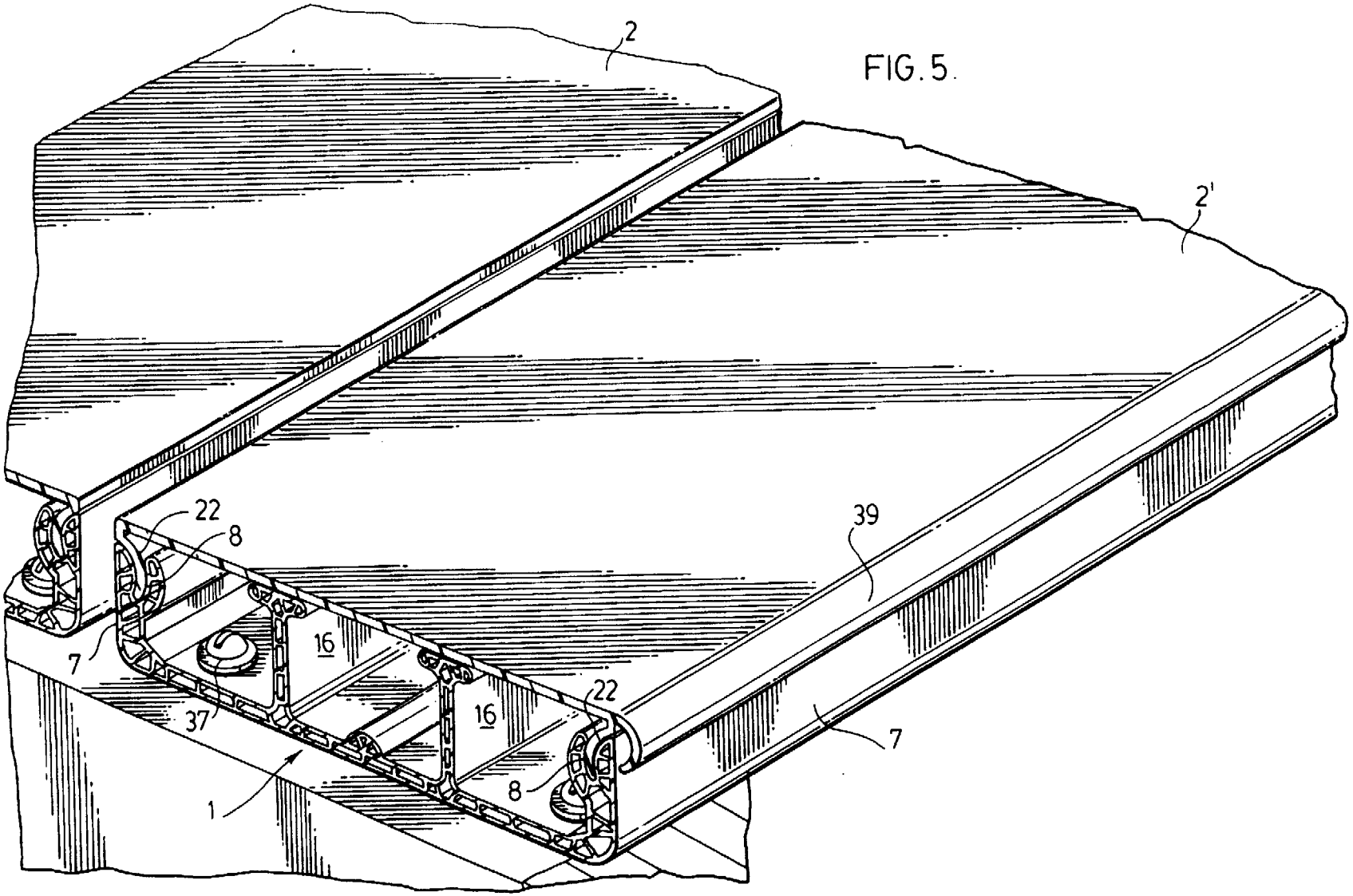
FIG. 5 is a broken away perspective view of planks according to the invention assembled to form a deck showing the cap of the outermost plank provided with a projecting rounded nose to provide an edge trim to the deck.

FIG. 5 illustrates a pair of planks mounted side by side with the left hand plank having the standard cap 2 while the right hand plank has a slightly modified cap 2' which has along one side a rounded depending nose portion 39 to provide an edge trim for the deck.

Figure 6:
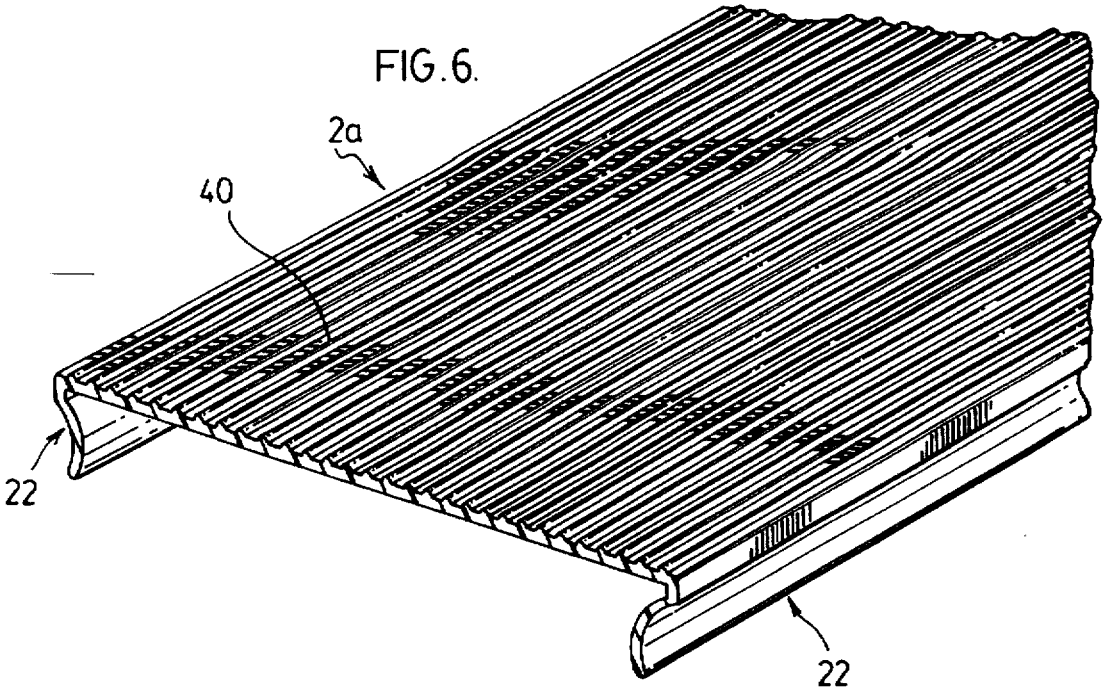
FIG. 6 is a broken away perspective view illustrating a cap in which the upper surface is ribbed to provide a non-skid surface.

FIG. 6 illustrates a slightly modified form of cap **2*a* which has a ribbed antislip upper surface 40 but otherwise is the same as cap 2**.

Figure 7:
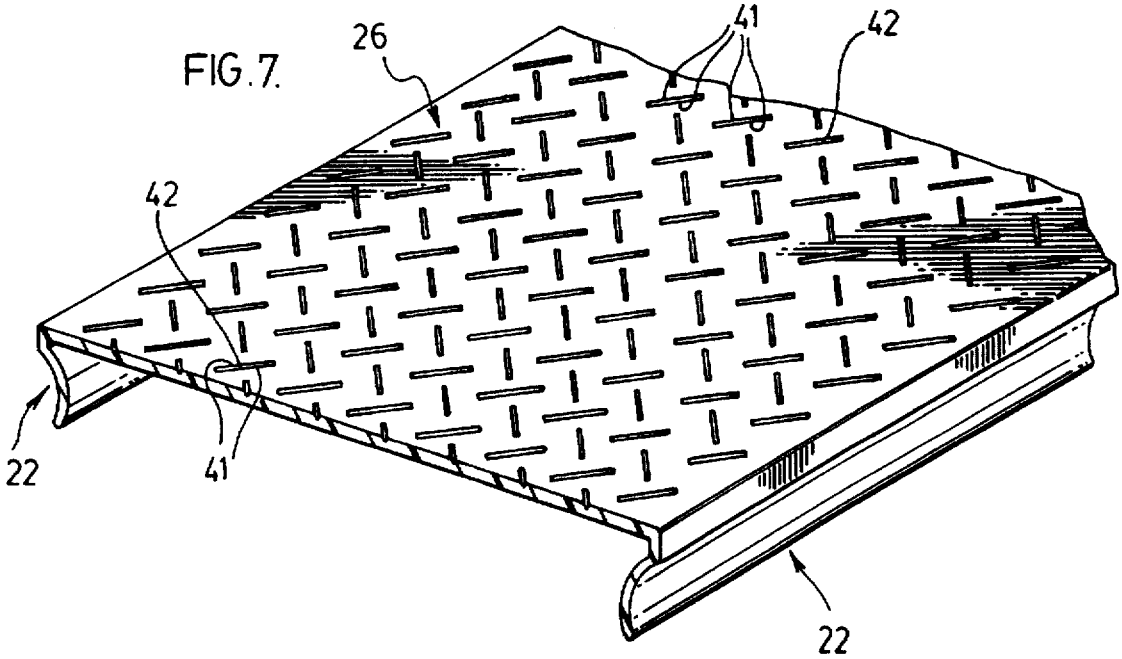
FIG. 7 is a perspective view of a plank cap having a pattern of grooves and ridges provide a different form of non-skid surface.

Similarly, FIG. 7 illustrates a cap **2*b* which has a pattern of ridges and grooves 41 and 42 respectively in its upper surface 43 to provide an antislip surface. Otherwise the cap is the same as cap 2**.

Figure 8:
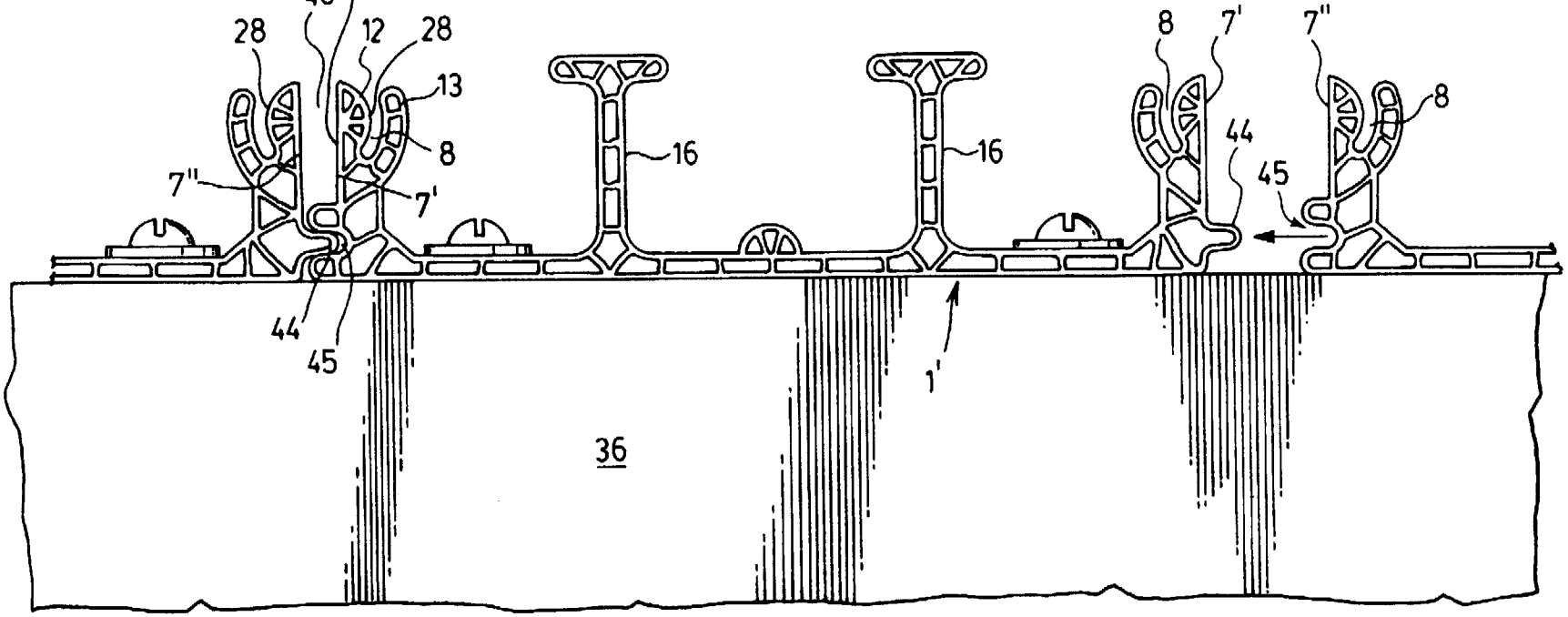
FIG. 8 is an end elevational view illustrating the erection of a deck using slightly modified plank base channels that are provided with a tongue and groove interconnection to provide a deck which protects the underside thereof against rain or snow.

It will be understood that the planks such as illustrated in FIGS. 2 and 4 can be mounted adjacent each other or in spaced relation as desired. FIG. 8 illustrates how the invention can be applied to planks which can be connected together by means of a tongue and groove. In this case, there are shown plank channels 1' which correspond in all respects to the channel 1 except that one of the channel walls 7' adjacent the bottom thereof is provided with an outwardly projecting tongue 44 while the opposite wall 7" is provided with a corresponding groove formation 45 adapted to receive the tongue portion 44 of an adjoining channel 2'.

These channels 2' are mounted in the same way as channel 2 and they are adapted to receive caps 2, 2*a* and 2*b* as desired.

It is important to note that the employment of the honeycomb structure of the channels 2 and 2' provides a significant advantage in weight to strength or rigidity ratio over a solid channel. Further and importantly the employment of the honeycomb structure greatly reduces the heat transfer by virtue of the heat dissipating and cooling effect of the internal voids so that heat is transferred away from the cap and dissipated rather than being transferred directly to the bottom wall 3 and the underlying support structure. The honeycomb structure of the bottom wall 3 further adds to the heat dissipation.

In addition, the broad support surfaces of the honeycombed heads 17 of the honeycombed support column 16 carries heat away from the cap 2 while the honeycomb structure of the walls of the sockets 8 carry heat away from the cap legs 22. Thus the sockets form heat dissipating recesses for the legs.

The net result is that when the plank is exposed to intense sun heat the rigidity of the channel 1 is maintained, the temperature of the cap 2 reduced and softening of the cap is minimized so that it remains safe and comfortable to walk on.

It will be understood that the caps such as cap 2, 2', 2*a* or 2*b* can incorporate any desired color with appropriate ultraviolet protecting agents so that decks of varying colors can be provided for aesthetic purposes. Also the caps can be colored to match the color of a wood deck and can be used to replace rotted, cracked or splintered wood planks in the deck.

It will be understood that when decks are formed using the channels 1' as illustrated in FIG. 8 the deck will also serve as a protective roof protecting the area therebeneath from rain or snow as the interlocked tongue and groove formations 44 and 45 respectively will block downward water flow while forming a run off channel 46 between adjoining interlocked channels 1'.

It will be understood that various modifications may be made to the details of the plank without departing from the scope of the invention as set forth in the appended claims.

The embodiment of the invention in which an exclusive property or privilege is claimed are defined as follows:

1. A plank for use in decks and the like comprising an elongated extruded channel of thermoplastic material having a generally planar mounting base having a width corresponding to a desired plank width, side walls projecting up from said base and having upper ends presenting cap locking sockets and upwardly projecting cap support means intermediate and higher than said side walls, said base, side walls, and cap support means having a honeycomb structure, and a generally planar elongated solid construction plastic cap which spans said side walls and having depending edge formations which interengage with said side wall sockets to positively secure said cap to said channel.

2. A plank as claimed in claim 1 in which said sockets at the upper ends of said channel wall are bordered to either side by exterior and interior honeycomb walls.

3. A plank as claimed in claim 2 in which said sockets at the upper ends of said channel walls are of arcuate form, and said edge formations comprise outwardly facing sickle shaped legs having a straight upper leg portion and a lower curved portion, the lower portions of the legs snap fitting into said sockets under pressure on said cap to close said channel.

4. A plank as claimed in claim 3 in which said upwardly projecting support means intermediate said channel wall comprise a pair of spaced T-shaped columns of a height to located the upper leg portions of the sickle shaped legs sit atop and flush with the exterior honeycomb wall to the outside of each socket.

5. A plank as claimed in claim 8 in which the spacing between said T-shaped columns is greater than the spacing between each of said columns and its respective adjacent side wall.

6. A plank as claimed in claim 9 in which said channel base has a central upwardly projecting longitudinal rib centrally expressed between said T-shaped columns.

7. A plank as claimed in claim 2, 3 or 4 in which the outer surface of said cap is provided with a slip resistant pattern.

8. A plank as claimed in claim 1 or 4, in which said cap has a downturned rounded nose extending along one longitudinal edge thereof.

9. A plank for use in decks and the like comprising an elongated thermoplastic channel having a mounting base, upwardly projecting side walls each terminating in a locking socket, and an upwardly projecting support means intermediate and taller than said side walls, and an elongated solid construction plastic cap which closes said channel and having depending locking edge formations which engage in the locking sockets of said side walls, said channel side walls having a honeycomb structure to dissipate heat and reduce heat transfer from said cap down to said mounting base and said sockets being bordered to either side by honeycombed walls to dissipate heat away from said depending edge formations.

10. A longitudinal channel member of extruded thermoplastic material for use in forming a plank for a deck or the like, said channel having a flat mounting base of honeycomb structure, a pair of upright side walls of honeycomb structure terminating in locking sockets bordered to either side by honeycomb walls and having a pair of spaced T-shaped columns between and taller than said side walls, said columns having a honeycomb structure.

11. A channel as claimed in claim 10 having a central longitudinal bead on said flat mounting base exposed between said columns.

12. A plank for use in decks and the like comprising an elongated plastic channel having a mounting base, a pair of upright sidewalls having upper ends terminating in cap engaging locking means and at least one upright support column located intermediately between said sidewalls, said sidewalls, said mounting base and said at least one intermediate support column all having a honeycomb structure, a generally planar plastic cap of solid construction having a width which bridges said sidewalls and is supported against deflection inwardly of said channel by said at least one intermediate support column, said cap having edge formations engaging and interlocked with said cap engaging locking means, said cap engaging locking means comprising a locking socket of arcuate form which provides spaced outer convex and inner concave recess wall camming surfaces in each channel sidewall, and said edge formations of said cap each comprising a depending outwardly facing sickle shaped leg having an upper straight vertical portion and a lower leg portion with a curvature corresponding to that of and snapping into said socket under downward pressure on said cap.

* * * * *